United States Patent [19]

Bryans

[11] 4,027,997

[45] June 7, 1977

[54] DIFFUSER FOR A CENTRIFUGAL COMPRESSOR

[75] Inventor: Alexander Connor Bryans, Reading, Mass.

[73] Assignee: General Electric Company, Lynn, Mass.

[22] Filed: Dec. 10, 1975

[21] Appl. No.: 639,232

[52] U.S. Cl. ..... 415/207; 415/211
[51] Int. Cl.[2] ..... F04D 29/44
[58] Field of Search ..... 415/211, 207, 181

[56] References Cited

UNITED STATES PATENTS

| | | | |
|---|---|---|---|
| 594,206 | 11/1897 | Jeffreys | 415/211 |
| 2,543,923 | 3/1951 | Mixsell | 415/211 |
| 2,596,646 | 5/1952 | Bachi | 415/207 |
| 2,708,883 | 5/1955 | Keller et al. | 415/207 |
| 3,420,435 | 1/1969 | Jarosz et al. | 415/211 |
| 3,719,430 | 3/1973 | Blair et al. | 415/211 |
| 3,743,436 | 7/1973 | O'Connor | 415/211 |
| 3,778,186 | 12/1973 | Bandukwalla | 415/211 |
| 3,861,826 | 1/1975 | Dean, Jr. | 415/211 |
| 3,905,721 | 9/1975 | Fitzpatrick | 415/211 |
| 3,930,746 | 1/1976 | Kronogard | 415/207 |
| 3,963,369 | 6/1976 | Balje | 415/181 |

FOREIGN PATENTS OR APPLICATIONS

| | | | |
|---|---|---|---|
| 459,801 | 9/1913 | France | 415/211 |
| 289,683 | 5/1929 | United Kingdom | 415/211 |

*Primary Examiner*—Henry F. Raduazo
*Attorney, Agent, or Firm*—James W. Johnson, Jr.; Derek P. Lawrence

[57] ABSTRACT

A diffuser provides a transition from a centrifugal compressor to the annular combustion chamber of a gas turbine engine. The diffuser comprises a plurality of linear passages which gradually merge radially outward from a circular cross-section to an outlet having a near rectangular cross-section defined by two flat opposing parallel sides and two opposing curved sides. The two opposing curved sides produce a razor sharp trailing edge which maximizes the diffuser efficiency. The linearity of the diffuser passage allows the diffuser to be manufactured to close tolerances by electric discharge milling an annular plate in a manner which assures uniformity and consistency between diffusers. The near rectangular shape of the outlet of the diffuser passages optimizes flow distribution to the annular combustion chamber. A transition region and deswirler section downstream of the near rectangular outlet may be provided to match the diffuser flow path to the combustor geometry.

1 Claim, 6 Drawing Figures

24
14
26
25
10
9
3
2
12
8
6
4
20
18
16
22
29
28
30

DIFFUSER FOR A CENTRIFUGAL COMPRESSOR

The invention described herein was made in the course of or under a contract or subcontract thereunder, or grant with the Department of the Army.

BACKGROUND OF THE INVENTION

The invention relates to a diffuser and, more particularly, to a diffuser for a centrifugal compressor which is configured to optimize flow distribution to a combustion chamber and which may be manufactured to close tolerances in a manner which assures uniformity between diffusers.

Centrifugal compressors generally include a rotating impeller arranged to accelerate and thereby increase the kinetic energy of a gas flowing therethrough. The diffuser is generally characterized by an annular space surrounding the impeller. The diffuser acts to decrease the velocity of the fluid flow leaving the impeller and thereby increase its static pressure. Prior art diffusers have generally included a plurality of circumferentially spaced passages which converge to the annular space surrounding the impeller. These passages expand in area downstream of the impeller in order to diffuse the flow exiting the impeller. It has been found for diffusers of this type which are to be utilized with gas turbine engines that it is preferable to have the diffuser passages assume an initial circular cross-section so as to accommodate with minimal losses the extremely high flow velocities of the gases exiting the impeller and thereafter gradually merge into a rectangular outlet to minimize losses which accompany flow exiting past a series of blunt edges as is found between a plurality of circular outlet passages. One diffuser of this type is disclosed in U.S. Pat. No. 3,719,430 issued to Blair et al on Mar. 6, 1973, and assigned to the assignee of this invention. The diffuser passages of the Blair et al application are generally conical for their entire length except for a merging section at the outermost radial end of the passage. In order to minimize the lengths, the merging section maintains a uniform cross-sectional area throughout the entire length such that there is no diffusion of flow therethrough. The outside circumferential edges of the diffusers are beveled to produce two converging frustoconical surfaces. Diffusers constructed in accordance with the teachings of the Blair, et al application have demonstrated significant improvements in the performance of centrifugal compressors for gas turbine engines. However, because of the complex geometry of the diffuser passages particularly at the outlet area which includes a merging section of uniform cross-section as well as scalloped edges diffusers of the type disclosed by Blair, et al have been found to be relatively expensive to manufacture and difficult to maintain the close tolerances required to assure uniformity between diffusers. Further, because of the relatively short length of the merging section there is a rather rapid change in the curvature of the walls of the merging section which tends to cause local flow separation with a resulting reduction in diffuser efficiency.

It is therefore the object of the present invention to provide a diffuser for a centrifugal compressor which is configured to optimize flow distribution to a combustion chamber and which may be easily manufactured to close tolerances in a manner which assures uniformity between diffusers.

SUMMARY OF THE INVENTION

The diffuser of the present invention comprises a plurality of linear passages in flow communication with an annular inlet surrounding the impeller of a centrifugal compressor. Each passage gradually merges from a circular cross-section at its inlet to a near rectangular cross-section at its outlet, defined by two flat opposing parallel sides and two flat opposing curved sides which produce a razor sharp trailing edge at the diffuser outlet. The near rectangular shape of the diffuser outlet optimizes the flow distribution to an annular combustion chamber in flow communication with the diffuser outlet. The linearity and regularity of the diffuser passages enables the diffuser to be manufactured to close tolerances by electric discharge milling an annular plate utilizing a single tool. This assures uniformity and consistency between diffusers. A transition and deswirler section may be provided downstream of the near rectangular outlet to match the diffuser flow path to the combustor geometry.

BRIEF DESCRIPTION OF THE DRAWINGS

The invention may be better understood upon reading the following description of the preferred embodiment in conjunction with the accompanying drawings in which.

DESCRIPTION OF THE PREFERRED EMBODIMENT

Figures 1, 2, 3, 4, 5, 6:
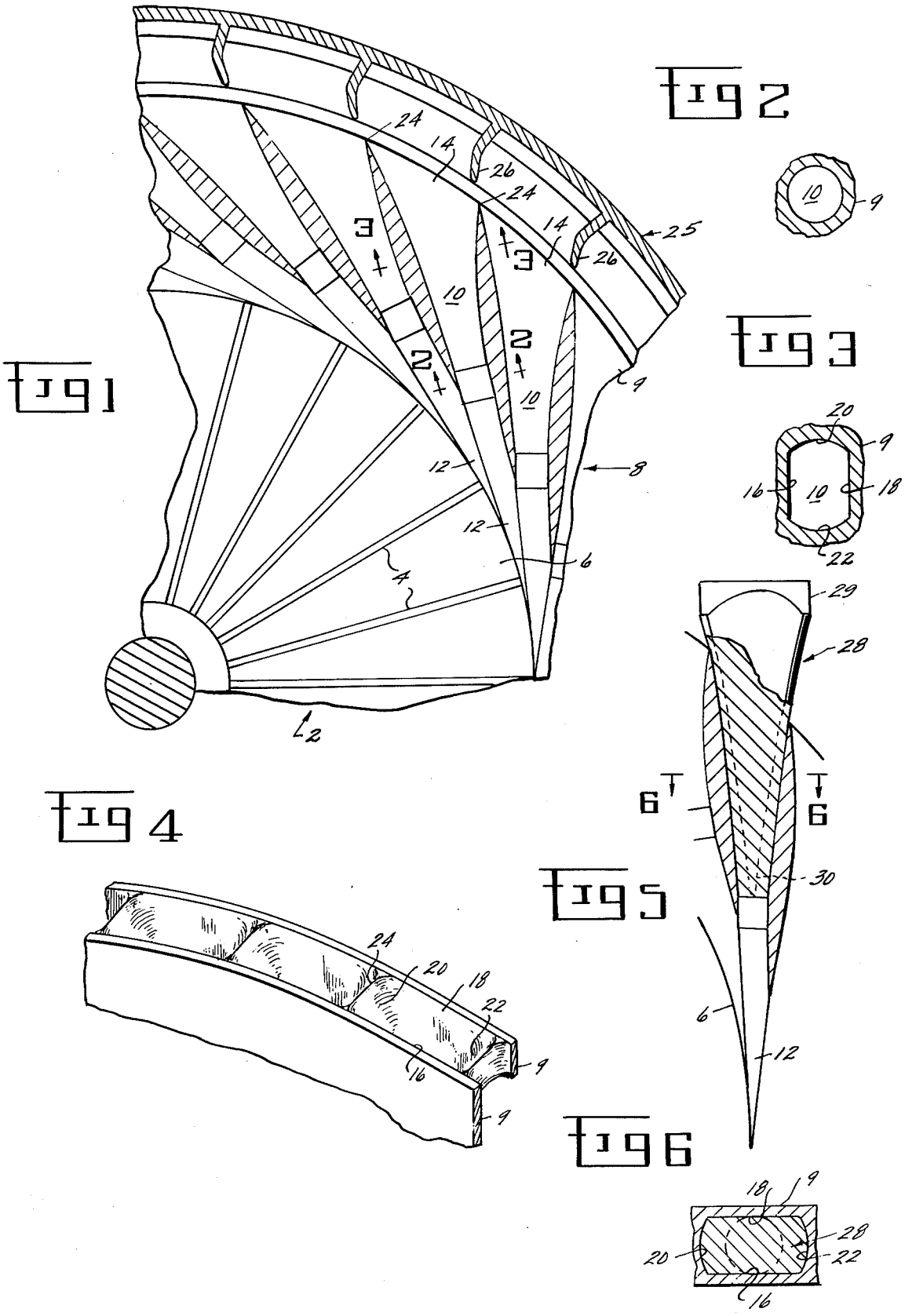
FIG. 1 shows a partial cross-sectional view of the diffuser of this invention in combination with a centrifugal compressor.
FIG. 2 shows a cross-sectional view taken along the line 2—2 of FIG. 1.
FIG. 3 shows a cross-sectional view taken along the line 3—3 of FIG. 1.
FIG. 4 is a perspective end view of the diffuser of this invention.
FIG. 5 shows a partial cross-sectional view of a tool which may be used to manufacture the diffuser of this invention.
FIG. 6 shows a cross-sectional view taken along the line 6—6 of FIG. 5.

Referring to FIGS. 1 through 4 there is shown a portion of a centrifugal compressor including an impeller 2. The impeller 2 includes a plurality of rotatable blades 4 circumferentially supported in spaced relationship by an annular web 6. The diffuser 8 of this invention includes an annular housing 9 having a plurality of passages 10 disposed therein. Each passage 10 includes an inlet 12 adjacent the web 6 of the impeller 2 so as to surround the outer tips of the impeller blades 4 and thereby receive the accelerated gases discharged from the impeller 2. The cross-sectional areas of the passages 10 gradually widen in a radially outward direction so as to diffuse the gases flowing therethrough and thereby convert the high kinetic energy of these gases into static pressure energy. The passages 10 initially assume a circular cross-section as best seen in FIG. 2 in order to minimize flow separation losses and thereafter gradually merge into a near rectangular cross-section, as best seen in FIGS. 3 and 4 such that the internal walls of the passages 10 in proximity to the diffuser outlet are formed as two flat opposing parallel walls terminating at 16 and 18 respectively and two opposed slightly curved walls which are convex with respect to the passage center line and which terminate at 20 and 22 respectively such that the cross-section of the outlets 14 of the passage 10 are defined by two flat opposing parallel sides 16 and 18 and two opposing curved sides 20 and 22 formed as arcs of a circle. Curved sides 20 and 22 produce razor sharp edges 24 intermediate the linear sides 16 and 18 such that there is a relatively smooth and uniform flow exiting the passages 10. The passages 10 also form a relatively sharp edge at their inlet.

In order to adapt the diffuser of this invention to a variety of combustor configurations, a transition region 25 may be provided at the downstream end of the passages 10.

In order to remove undesirable swirl in the flow exiting the transition region 25 a plurality of circumferentially spaced apart deswirl vanes 26 may be provided within the transition region 25. The flow exiting the deswirler vane 24 is thereafter directed to a combustion chamber (not shown).

It now becomes obvious that the unique diffuser of this invention lends itself to relatively inexpensive manufacturing techniques which can maintain close tolerances and uniformity between diffusers. Because the centerline as well as the walls of the diffuser passages 10 are linear and make a gradual and smooth transition from a circular cross-section to a near rectangular cross-section, the diffuser 8 may be easily manufactured by known electric discharge milling techniques. Thus, the annular housing may be an electric discharge milled utilizing a single tool to produce the diffuser of this invention. An electric discharge milling tool 28 suitable for producing the diffuser passages 10 is shown in FIGS. 5 through 7. The tool 28 assumes a circular cross-section at its upstream end 30 and gradually merges radially outward into a near rectangular cross-sectional area identical to the desired outlet cross-sectional area of the passages 10. The tool 28 is provided with relatively sharp edges 29 in order to produce the relatively sharp opposed curved sides 20 and 22 at the passage outlet 14.

While a preferred embodiment of the present invention has been depicted and described, it will be understood that many modifications and changes may be made thereto without departing from the scope of the invention as defined in the appended claims.

What is claimed is:

1. A diffuser for diffusing the accelerated gas flow from a relatively high pressure centrifugal compressor to an annular combustion chamber comprising:

an annular housing circumscribing the centrifugal compressor;

a plurality of passages spaced about the circumference of the housing and extending therethrough, each passage having a substantially linear center line;

wherein the inlet to each of the passages is circular in cross-section and disposed to receive the accelerated gases exiting the centrifugal compressor and each of the passages gradually merge to a near retangular cross-section at its outlet which is defined by two float opposing axial spaced parallel sides and two opposing curved circumferential sides formed as arcs of a circle, such that the internal walls of the passages in proximity to the diffuser outlet are formed as two flat parallel walls and two opposed slightly curved walls with the curved walls being convex with respect to the passage center line; and wherein the curved walls terminate in a relatively sharp edges at the diffuser inlet and outlet.

* * * * *